United States Patent [19]

Kinberg et al.

[11] Patent Number: 4,575,070

[45] Date of Patent: Mar. 11, 1986

[54] ROTATABLE TOY ASSEMBLY

[76] Inventors: Benjamin Kinberg, 200 Fifth Ave., New York, N.Y. 10010; Ronald R. Klawitter, 210 Wharf St.; Bev W. Taylor, R.R. 2 Box 198, both of Hermann, Mo. 65041

[21] Appl. No.: 656,963

[22] Filed: Oct. 2, 1984

[51] Int. Cl.[4] ..... A63G 1/12

[52] U.S. Cl. ..... 272/33 R; 272/43

[58] Field of Search ..... 272/33 R, 33 A, 33 B, 272/39, 43, 44, 45, 1 R, 1 C, 17, 18, 31 R, 31 A, 31 B, 31 P; 434/55, 62, 71; 446/230, 231, 404, 7, 193

[56] References Cited

U.S. PATENT DOCUMENTS

| | | | |
|---|---|---|---|
| 843,908 | 2/1907 | Olson | 272/33 R |
| 1,213,931 | 1/1917 | Milonczyk | 272/33 R |
| 1,494,038 | 5/1924 | Szabo et al. | 272/33 R |
| 1,529,512 | 3/1925 | Smerechanski | 272/33 R |
| 2,581,976 | 1/1952 | Solomon | 446/7 |
| 2,839,297 | 6/1958 | Switzer | 272/33 R |
| 3,677,541 | 7/1972 | Race | 272/33 R |

FOREIGN PATENT DOCUMENTS

| | | | |
|---|---|---|---|
| 282419 | 4/1952 | Switzerland | 272/33 |
| 350628 | 6/1931 | United Kingdom | 272/39 |

*Primary Examiner*—Robert A. Hafer
*Assistant Examiner*—Arnold W. Kramer
*Attorney, Agent, or Firm*—Polster, Polster and Lucchesi

[57] ABSTRACT

A rotatable toy assembly wherein a body member contoured in the form of an automobile to support a child is rotatably supported on a base member, the toy assembly including a drive arrangement operable by a child supported on the body member to cause rotation of the body member about the base member.

3 Claims, 5 Drawing Figures

ROTATABLE TOY ASSEMBLY

BACKGROUND OF THE INVENTION

The present invention relates to a toy assembly and more particularly to a rotatable toy assembly which includes a body member contoured in the form of an automobile to support a child and which is rotatably supported on a base member, a drive arrangement operable by a child supported on the body member being disposed between the body member and base member to cause rotation of the body member about the base member.

Toy assembly arrangements which are capable of supporting a child and which include a body member rotatable about a base memeber have long been known in the toy art, attention being directed to unexpired U.S. Pat. No. 3,873,087, issued to Jacob W. Burkart, et al, on Mar. 25, 1975, which discloses such an arrangement. Such arrangements, which basically utilize the principle of a "merry-go-round" have been appealing to the visual and participating interests of children.

The present invention provides a toy assembly which includes such a merry-go-round principle which can be readily and economically manufactured and assembled efficiently and economically with a minimum of parts, and yet permits manipulation by a child supported thereon. In addition the toy assembly of the present invention lends itself readily to a configuration simulating moving vehicles used by adults, with mechanical parts included which enhance such movement and which are readily and manually operable by a child with a minimum of effort and skill. Such manual use by a child not only enhances the child's manipulative skills and hand-eye coordination, but, in addition, serves to provide many hours of amusement. Various other features of the present invention will become obvious to one skilled in the art upon reading the disclosure hereinafter.

SUMMARY OF THE INVENTION

More particularly, the present invention provides a rotatable toy assembly comprising: a base member; a body member rotatably mounted relative the base member, the body memeber being contoured to support a child for rotational movement therewith; a drive assembly between the rotatable body member and the base member including a rotatable drive member and a stationary member engageable by the drive member, one of the members of the drive assembly being positioned on the base member and the other on the body member; and, manual actuating means on the body member connected to the drive assembly and positioned to be actuated by a child supported thereon to rotate the drive member and cause the body member to rotate about the base member. In addition, the present invention provides a coupler assembly associated with the drive assembly positioned to be actuated by a child supported on the body member to control rotational movement of the body member about the base member.

It is to be understood that various changes can be made in the arrangement, construction and form of the several parts of the apparatus disclosed herein without departing from the scope or spirit of the present invention. For example, the configuration utilized for the body member can be a vehicle other than an automobile such as an airplane, a truck or a helicopter. Further, the drive member can be positioned on the base and the stationary member on the body. In addition, camming devices could be utilized to effect elevation and it is even conceivable to alter the path of body movement about the base member through other gearing arrangements.

BRIEF DESCRIPTION OF THE DRAWINGS

Referring now to the drawings which disclose an advantageous embodiment of the rotatable toy assembly of the present invention and several alternative drive assembly variations.

DESCRIPTION OF THE PREFERRED EMBODIMENTS

Figure 1:
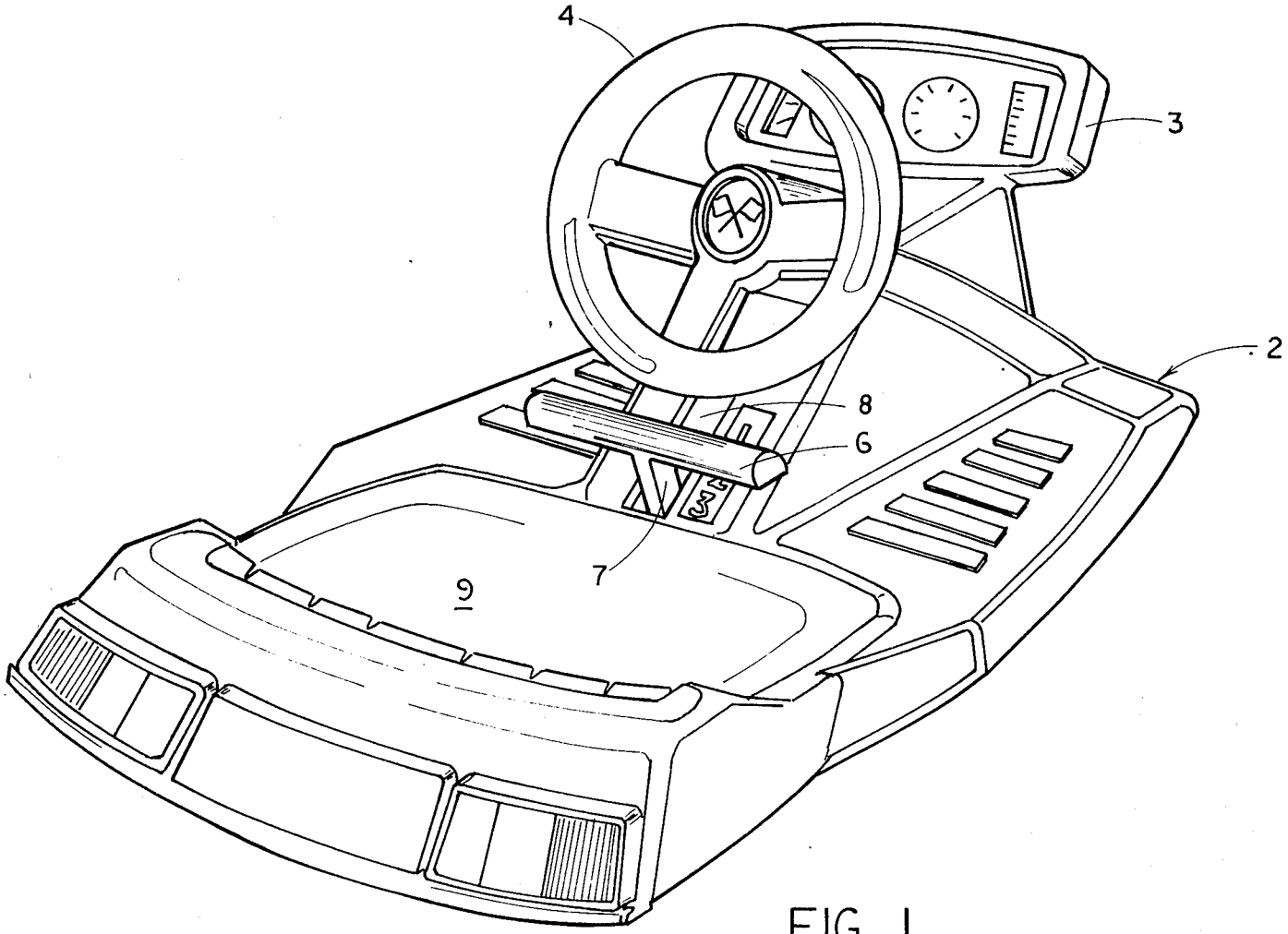
FIG. 1 is an isometric view from above of the exterior of a body member in the configuration of an automobile.

Referring to FIG. 1, the novel rotatable toy assembly is disclosed as including a body member 2 which can be formed from any one of a number of suitable materials such as plastics or metal. Ideally, a suitable sturdy, moldable plastic can be used. In the embodiment disclosed body member 2 is disclosed as an automobile but it is to be understood that other molded simulated vehicle configurations could be used such as an aeroplane, helicopter, truck or military tank. As disclosed in FIG. 1, body member 2 includes an instrument panel 3 molded as part of the body member 2, a rotatable steering wheel 4, described hereinafter—and a coupler or clutch handle 6 connected to one end of actuator arm 7 which is moveable in slot 8 of body member 2. It is to be noted that body member 2 is provided with a seat 9, the body member and seat being so sized and of sufficient strength to support a child thereon.

Figure 2:
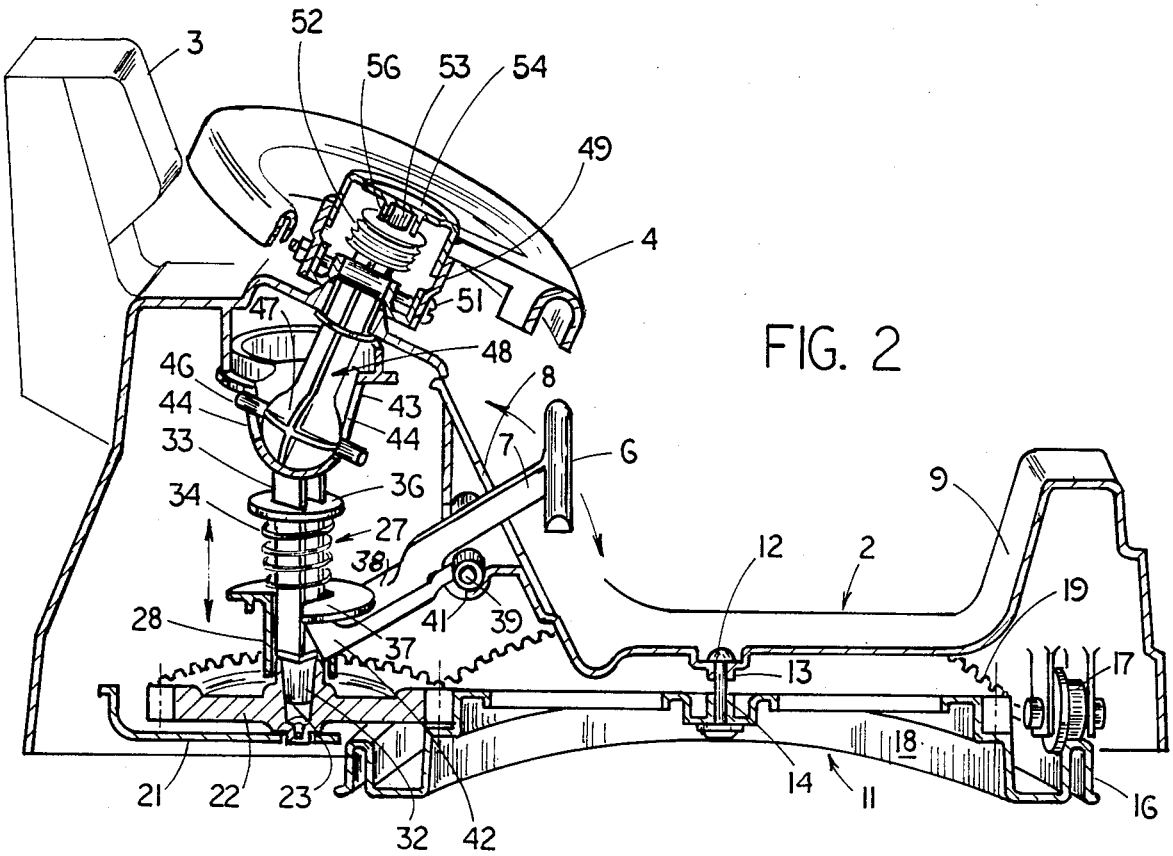
FIG. 2 is an isometric cut away of the body member of FIG. 1, disclosing more fully the novel features of the present invention, including a portion of the base member upon which the body member is rotatably mounted.

Referring to FIG. 2 of the drawings, it can be seen that body member 2 is rotatably supported on a circular base member 11, the base 11 and body member 2 being connected by rivet 12 which extends through suitable opposed aligned guide sleeves 13 and 14 in the body member 2 and base member 11 respectively, these guide sleeve and rivet being so positioned that body 2 rotates about the central vertical axis of base 11.

As can be seen in FIG. 2, base 11 is provided with an integral circular rail 16 extending around the outer periphery of base 11. A set of spaced roller assemblies 17, not described in detail herein and only one of which is shown for illustration purposes, not in its normal position, are mounted on body 2 to engage rail 16. It has been found advantageous to employ six such roller assemblies 17 suspended in a circular fashion from the underside of body 2 in a pattern which conforms with rail 16, the roller assemblies 17 thus being equally spaced from each other in approximately 60° arcs.

Positioned inwardly from rail 16, slightly thereabove on a raised inner platform 18 formed as an integral part of base 11 is a stationary, circular gear tooth rack 19 extending around the periphery of platform 18 in spaced parallel relation with circular rail 16. Rotatably mounted on gear wheel cover 21 which forms a bottom gear covering portion of body member 2 is drive gear 22, the gear 22 being so positioned as to have the teeth thereof engage with the teeth of stationary rack 19. Gear 22 is provided with a stub 23 projecting centrally from the upper face thereof.

Figure 3:
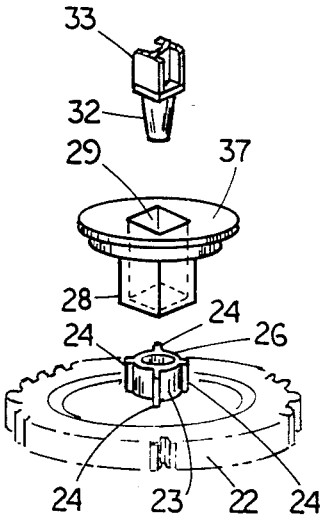
FIG. 3 is an exploded view of a portion of the clutch or coupler assembly and drive member of FIG. 2.

Referring to FIG. 3, spaced vertical ribs 24 are positioned along the outer wall of stub 23 to define a male stub portion of a coupler assembly, such stub portion having an outer rectangular cross-section. Male stub portion 23 is provided with an aperture 26 therein of circular cross-section to rotatably receive one end of a drive shaft section 27 described more fully hereinafter.

As can be seen in FIGS. 2 and 3 of the drawings, the female portion of the coupler assembly is in the form of a flanged tube or sleeve 28 having a longitudinally extending passage 29 therethrough of rectangular cross-section sized to nestingly engage with ribs 24 of male stub portion 23. Extending through the passage 29 of female portion 28 of the coupler assembly is the aforementioned vertically extending longitudinal drive shaft section 27. Shaft section 27 is provided with an end portion 32 of tapered configuration sized to rotatably engage in the aperture 26 of drive gear 22. The upper portion 33 of drive shaft section 27 is in the form of an I-beam and is sized to pass freely through longitudinal passage 29 of the female portion 28 of the coupler, the rectangular peripheral cross-section thereof engaging with ribs 24 on stub 23 to rotate the coupler assembly when in engagement and when the shaft section 27 is rotated. To assure engagement of the male portion 23 with the female portion 28 of the coupler assembly, a helical compression spring 34 is positioned between flange 36 which is integral with the upper portion 33 of shaft section 27 and flange 37 of flanged tube or sleeve of female portion 28 of the coupler assembly. Thus, when shaft 27 is rotated and the male and female portions of the coupler or clutch are in nesting engagement, drive gear 22 is caused to rotate. Since the gear teeth of drive gear 22 mesh with the teeth of stationary rack 19 on base member 11, the body member 2 upon which gear 22 is rotatably positioned is caused to rotate about base member 11 in the same direction as gear 22 is rotated, the rotating teeth of gear 22 pushing off against the stationary teeth of rack 19 to move body 2 upon which gear 22 is mounted therealong. To disengage the female portion 28 of the coupler assembly from the stub male portion 23 of the coupler assembly, aforedescribed coupler actuator arm 7 extending through slot 8 of body member 2 is utilized. It is to be noted that actuator arm 7 has intermediate thereof integral pivot pins 39 extending laterally therefrom to engage in a cradle 41 on body member 2. End 38 of actuator arm 7 opposite aforedescribed handle 6 is provided with forked boss arrangement 42 (not disclosed in detail) which straddles the female portion or sleeve portion 28 of the coupler assembly to abut against the flange 37 thereof. When handle 6 is urged downwardly by a child positioned on body member 2, the actuating arm 7 pivots about lateral pins 39 in cradle 41 with forked boss 42 abutting flange 37 to move female portion 28 against spring 34 and disengage it from nesting relationshp with stub male portion 23, tapered shaft end 32 of shaft 27 rotating freely in aperture 26 when wheel 4 is turned but drive gear 22 itself not rotating. When actuating arm 6 is released, the clutch or coupler assembly engages upon rotation of vertical drive shaft section 27 with accompanying rotation of drive gear 22. To rotate shaft 27, the upper end thereof is provided with an integral cradle 43 having slots 44 therein. These slots 44 in turn receive pins 46 projecting from opposite sides of ball end 47 of an inclined universal section 48 extending through body member 2. It is to be noted that universal section 48 can be formed from flat ball shaped rib members which cross each other to provide an "X" cross-section, thus saving material and decreasing weight. The end of universal section 48 opposite ball end 47 is connected to a cup 49 mounted integrally with the underside of aforedescribed wheel 4 by means of a suitable nut, pin and spacer assembly 51.

Arranged to abut against such end of universal section 48 in spaced relation with cup 49 is an expansible compressible air bellows 52 having a sound accentuator or horn 53 connected to its opposite end. A horn button in the form of a cup 54 slidably nesting with cup 49 and projecting through wheel 4 has an internal annular actuating lip 56 projecting therefrom to engage against the bellows 52 to compress the same when button 54 is pressed inwardly to force air through sound accentuator 53 so as to emit a sound.

Thus, with the arrangement above described a rotating toy assembly is provided which can be driven by a child supported thereon in an easy and ready manner to simulate the operation of an automobile and the motion of a merry-go-round, the arrangement being manufacturable in an efficient and economical manner with a minimum of parts.

Figure 4:
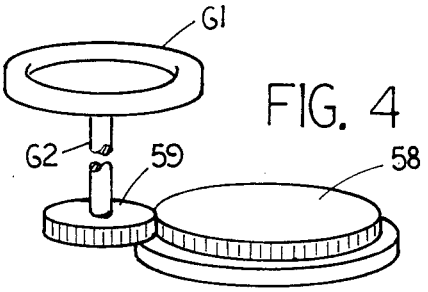
FIG. 4 is a schematic isometric of a modified drive arrangement which can be employed with the novel toy assembly of FIGS. 1–3, and, FIG. 5 is a schematic isometric of still another drive arrangement employable with the novel toy assembly of Figures 1–3.
Figure 5:
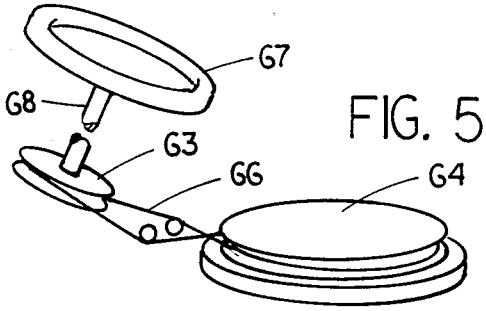

In FIGS. 4 and 5 alternative drive assemblies are disclosed which can also be utilized with the above toy assembly. In Figure 4, the stationary gear 58 and drive gear 59 are shown as mounted in a horizontal plane, as is steering wheel 61 with connecting drive shaft 62 extending vertically downward without a universal connection, the arrangement thus simulating that of an auto bus.

In FIG. 5, a rotatable sheave 63 is disclosed as being connected to a stationary sheave 64 through a sheave belt 66 in crossed-over "figure eight" configuration so that the body member rotates relative the base member in the same direction that inclined wheel 67 connected to drive sheave 63 by shaft 68 rotates. It is to be understood that sheaves 63 and 64 can be in tooth or gear form with belt 66 being in link chain form with the links engaging with the teeth.

It also is to be understood, that other alternative drive assemblies can be utilized with the above toy assembly without departing from the scope or spirit of the present invention. For example, an inclined drive shaft having a beveled, slidably mounted, internally splined drive gear at one end thereof can be utilized to engage with the stationary gear through an appropriately beveled gear train assembly not shown in the drawings, the beveled drive gear being slidably moveable along the drive shaft by a suitable manual actuating member to engage and disengage the gear train assembly when so desired.

The invention claimed is:

1. A rotatable toy assembly comprising: a circular horizontal stationary base member having a stationary circular gear tooth rack and a circular rail member extending in spaced integral relationship about the periphery thereof; a hollow body member in the configuration of an automobile body and adapted to support a child for movement therewith rotatably mounted on said base member for rotational movement about the central vertical axis thereof; a plurality of spaced rollers mounted on said body member to engage said circular rail member on said base member; a drive gear mounted in a horizontal plane on said body member to engage said circular gear tooth rack on said base member; said drive gear having a stub member projecting centrally in a vertical fashion from the upper face thereof, said stub member having an outer rectangular cross-section and an aperture therein of circular cross-section, said stub member thus forming the male portion of a coupler assembly; a female portion of said coupler assembly in the form of a flanged sleeve having a passage therethrough of rectangular cross-section sized to nestingly engage with the male portion of said coupler assembly; a longitudinal drive shaft section extending vertically through said female portion of said coupler assembly, said shaft section having a tapered portion at one end thereof to rotatably engage in the aperture of said stub member with the opposite end of said drive shaft being contoured in the form of a slotted cradle, the portion of said shaft passing freely through the passage of said female coupler being of rectangular cross-section to rotate said coupler therewith when said shaft is rotated, and having a flange extending normally therefrom in spaced parallel relation to the flange of said coupler; a helical compression spring surrounding said shaft between said spaced parallel flanges to yieldingly urge said male and female portions of said coupler into nesting engagement; a coupler actuating member extending through said hollow body member; said actuating member including intermediate pivot pin members adapted to pivotally engage in a contoured cradle on said body member; an actuating handle at one end and a forked boss arrangement at the opposite end to straddle said female portion of said coupler assembly to disengage said male and female portion of said coupler assembly when the handle is actuated downwardly by a child supported on said body member; an inclined universal section extending through said body member and having a ball member at one end having pin means to engage with said slotted cradle on said vertical drive shaft section; a steering wheel fixed to the opposite end of said universal section and extending above said body member in an angular plane to simulate an automobile driving wheel and to be readily accessible for manual operation by a child supported on said body member to rotate said drive shaft; and a horn assembly mounted on said steering wheel for manual operation by such child.

2. The apparatus of claim 1, said horn assembly comprising an expansible-compressible air bellows member fixed at one end to said universal section and having an air operated sound accentuator connected to its opposite end adapted to emit a sound when said bellows is actuated; and an actuator button slidably extending through said steering wheel to compress said bellows when pressed downwardly by a child.

3. In a rotatable toy assembly comprising a base member; a body member rotatably mounted on and relative to said base member, said body member being contoured to support a child for rotational movement therewith; a drive assembly between said rotatable body member and said base member including a rotable drive member and a stationary member engageable by the drive member, one of said members of said drive assembly being on said base member and the other on said body member; and manual actuating menas connected to said drive assembly and positioned to be actuated by a child supported thereon to rotate said drive member and cause said body member to rotate, the improvement comprising said rotatable drive member having an upwardly extending hub with a bearing section and a non-circular section; said drive assembly including a vertical shaft, non-circular in cross-section through a part of its length, said shaft having a flange at an upper end and a bearing section, circular in cross-section, at its lower end, complementary to said rotatable member hub bearing section and rotatably mating therewith; a female coupler having a sleeve with a non-circular longitudinal passage complementary to said non-circular part of said vertical shaft and slidably mounted thereon, a coupler flange at an upper end of said sleeve and a section at its lower end adapted slidably but non-rotatably selectively to engage the non-circular section of said rotatable member hub; compression spring means mounted on and around said vertical shaft between said shaft flange and said coupler flange for biasing said coupler section toward engagement with said non-circular hub section, and lever means, one end of which is readily accessible to said child, pivoted to said body member and having means within said body member for engaging said coupler flange for selectively moving said coupler, against the bias of the spring, out of engagement with said hub.

* * * * *